United States Patent [19]

Dunn et al.

[11] 4,149,767

[45] Apr. 17, 1979

[54] SELF-SHEARING CONNECTOR FOR ELECTRICAL CONDUCTORS

[75] Inventors: Robert B. Dunn, Ottawa; Terence A. Ashby, Carleton Place; Frank R. Campbell, Ottawa, all of Canada

[73] Assignee: Northern Telecom Limited, Montreal, Canada

[21] Appl. No.: 892,889

[22] Filed: Apr. 3, 1978

[51] Int. Cl.[2] ..... H01R 9/08

[52] U.S. Cl. ..... 339/97 P

[58] Field of Search ..... 339/97 R, 97 P, 97 S, 339/97 T, 98

[56] References Cited

U.S. PATENT DOCUMENTS

| | | | |
|---|---|---|---|
| 2,078,825 | 4/1937 | Wisner | 339/97 R |
| 2,372,653 | 4/1945 | Becket | 339/97 R |
| 3,066,274 | 11/1962 | Ellis, Jr. | 339/97 R |
| 3,171,705 | 3/1965 | Zdanes | 339/97 R |

*Primary Examiner*—Joseph H. McGlynn
*Attorney, Agent, or Firm*—Sidney T. Jelly

[57] ABSTRACT

A self-shearing connector for electrical conductors comprises a helical spring of rectangular cross-section wire around a central member extending from a body member. The spring has an upper or end turn with an end part of an external diameter smaller than the inner diameter of the next or lower turn. On compression of the spring the end part of the upper or end turn is pushed down into the next turn shearing off the end of the conductor. The conductor is gripped between the lower turn and the body or between the spring turns. If the conductor is insulated, the gripping pressure splits the insulation at opposite sides of the conductor to provide electrical contact.

12 Claims, 8 Drawing Figures

SELF-SHEARING CONNECTOR FOR ELECTRICAL CONDUCTORS

This invention relates to a self-shearing connector for electrical conductors and is particularly concerned with connectors having a central post or similar member around which a conductor is wrapped after which the wire is clamped.

In conventional connectors, a conductor is wrapped around a central member and then clamped, as by screwing down a nut on a threaded central member, or by making the central member in the form of a headed screw and screwing down the screw into the connector body. Any excess conductor end may be cut off, or care is taken to ensure no end is left extending from the connection. If the conductor is a bare wire or wires, it is particularly important that no excess wire extend from the connection. For insulated conductors, which may also be a single wire or a plurality of wires, the insulation is first stripped and then the wire or wires, referred to for convenience hereinafter as the conductor, is wrapped round the central members and then clamped. Such connections are time consuming in that prestripping is required. Again lengths of conductor extending from the connection should be avoided, to avoid shorting.

The present invention provides a connector having a central member extending from a body member and around which is positioned a helical compression spring of rectangular cross-section wire. The spring has an upper or end turn having an end part having an outer diameter smaller than the inner diameter of the next lower turn, such that on compressing the spring the end part can be pushed into the next turn. The end part is a close sliding fit in the next lower coil. When a conductor is positioned between the spring turns, tightening shears off the excess length of conductor. Also, when an insulated conductor is used, the insulation is split by the clamping pressure to give electrical contact.

A variety of forms of central member and of clamping arrangements can be provided, plus other features, as will be evident by the following description of certain embodiments, by way of example, in conjunction with the accompanying drawings, in which.

Figure 1:
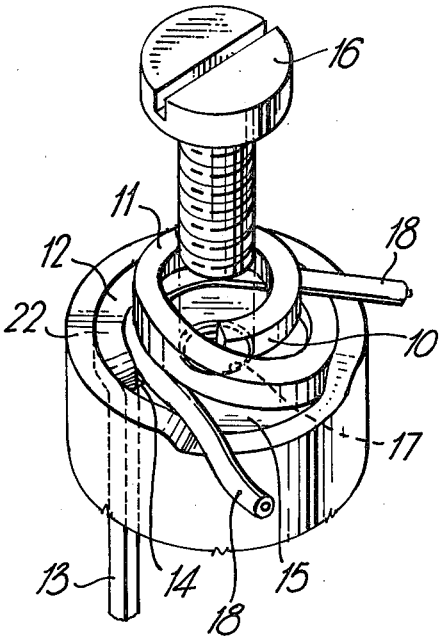
FIG. 1 is a perspective view of illustrating the basic features of the invention.

FIG. 1 illustrates a simple form of the invention, in which a helical compression spring 10 of rectangular cross-section wires, in the present example square, has an upper or end coil 11 of a smaller coil diameter than the inside diameter of the next coil 12, coil 12 extending for only part of a circle. As an example, the spring is formed by bending the wire to form the bottom coil, extending for say about half a circle and then spiralling the wire inward to form the upper or end coil which can be pushed down inside the bottom coil, with a close fit. The other end of the spring comprises a tail portion 13 which is positioned in a hole 14 in part of the main body 15. A central member, in the example a metal headed screw 16, enters a threaded hole 17 in the body 15. As the screw tightens it forces the end coil 11 down into the next coil 12, shearing off the excess end of the conductor 18 which is positioned between the coils. The conductor is gripped between the end coil 11 of the spring and the body 15. This gripping splits the insulation, at top and bottom of the conductor to enable a reliable electrical contact to be made between screw and conductor, and also between body 15 and conductor. If no insulation is present then the bare conductor is gripped between the coil 11 and the body 15.

Figure 2:
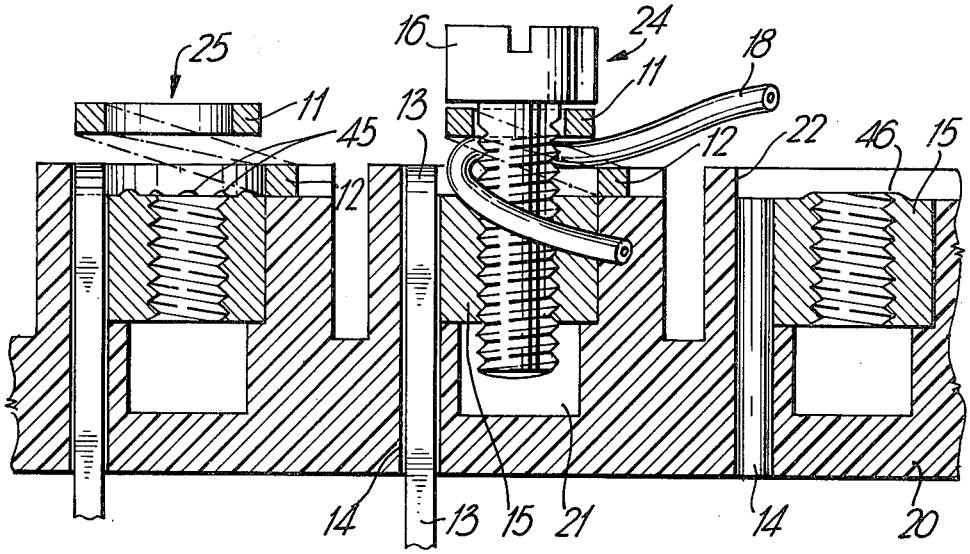
FIG. 2 is a cross-section through a connector block, with two forms of connection.
Figure 3:
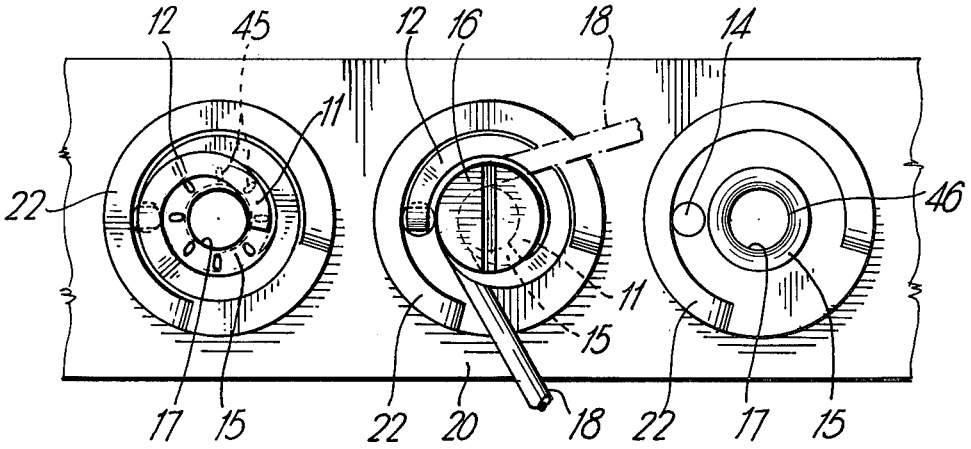
FIG. 3 is a plan view of the connector block of FIG. 2.

FIGS. 2 and 3 illustrates a connector block 20 having three connector positions with two alternate forms of spring, indicated generally at 24 and 25. In example 24, the main body 15 is in the form of an insert molded into the connector block 20. The tail portion 13 can be used for wire wrapping a conductor thereto or for otherwise connecting a conductor. The screw 16 enters a clearance hole 21 formed in the block 20. FIG. 2 illustrates the situation when the conductor 18 has been inserted between the spring coils 11 and 12, before tightening the screw 16 and shearing off the excess length of the conductor.

To ensure that the conductor is correctly positioned, the main body 15 can be provided or formed with a raised rim 22, as in FIG. 1. This rim extends, in the example, approximately 270° and the unraised portion, between the rim ends, defines the arc where the conductor 18 enters the connector. The coil or turn 12 does not extend for the unraised portion of the rim. The conductor can be removed by slackening the screw 16, the end coil 11 of the spring returning to its original position and freeing the conductor, which can be removed without leaving portions of insulation behind. If no connection is required to the tail portion 13 then this can be much shorter, serving only to prevent rotary movement of the spring when the screw 16 is tightened. In FIG. 3 the conductor 18 is indicated in full for that part which is retained in the connector, while the sheared portion is indicated in dotted outline.

The example indicated at 25 has the spring formed with a complete lower turn or coil 12 with the upper or end coil 11 reducing in an outer diameter so that the end part can slide down inside the lower coil. Part of the end coil 11 overlies the lower coil and in this arrangement the conductor is gripped between the two coils at one position and has the end sheared at the position where the end part of the end coil passes down inside the lower coil.

To ensure clean shearing, the end part of the end coil is a fairly close sliding fit inside the lower coil. As in the example indicated at 24, and illustrated in FIG. 1, for an uncoated, or bare, conductor, the conductor is clamped directly, in the present instance between the two coils. For an insulated conductor, the clamping pressure splits the insulation at top and bottom and allows contact to be made between the spring and the conductor.

Figure 5:
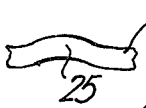
FIG. 5 is a developed view of the partial outer coil of the spring in FIG. 4, in the direction of arrow A in FIG. 4.
Figure 4:
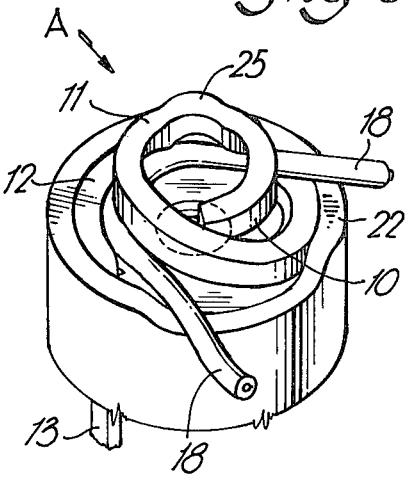
FIG. 4 illustrates a modification to the arrangement of FIG. 1.

To ensure pressure is continuously applied to the conductor, even if some slight slackening of the screw occurs, for example by relaxing of the threads in the body 15, deformation can be formed in the end coil 11 to provide some stored spring energy. Thus, as illustrated in FIGS. 4 and 5, an upward deformation 25 is made in the end coil 11. This deformation is at least partly flattened on tightening the screw 16, but will provide loading or pressure on the conductor if some slackening occurs.

In the examples of FIGS. 1 to 5, a screw 16 has been used as a clamping member, screwing into a threaded hole in the main body 15. An alternative arrangement is to provide a stud molded or otherwise fixed in the connector block.

Figure 6:
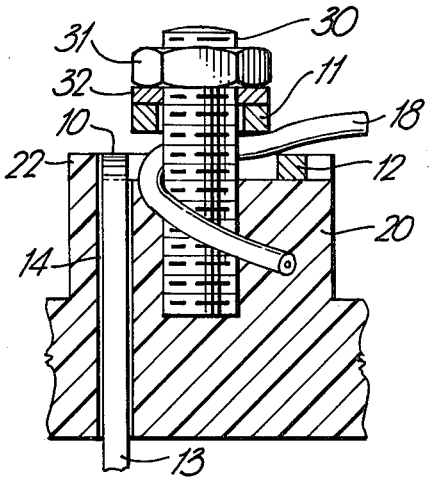
FIG. 6 is a cross-section through a further form of connector.

FIG. 6 illustrates one form of such an arrangement. A stud 30 is inserted in the connector block 20. The stud can be molded in, or can be inserted after manufacture of the connector block. In this example there is not necessarily a separate main body, although a molded-in insert can be provided for acceptance of the stud. If there is no main body member, or other insert, then the rib 22 is formed directly on the connector block. A nut 31 is the clamping member, and a washer 32 is also provided, in the example of FIG. 6. A washer can also be provided in the examples in FIGS. 1 to 5.

Figure 7:
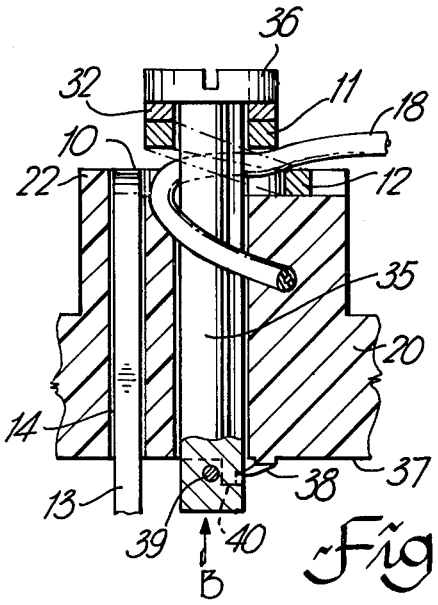
FIG. 7 is a cross-section through another form of connector.
Figure 8:
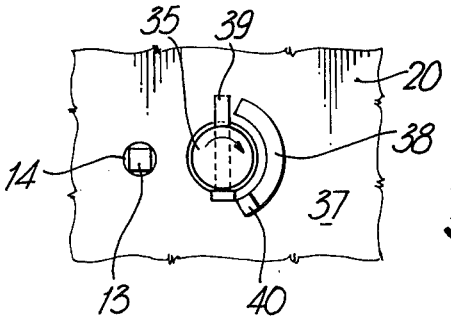
FIG. 8 is a view on the bottom of a connector as in FIG. 7, in the direction of the arrow B in FIG. 7.

The examples illustrated and described so far use threaded members to provide the clamping, and shearing, movement and tightening down of the end coil 11 of the spring 10. An alternative is to pull down on the spring by some suitable cam action. In FIGS. 7 and 8 an arrangement is illustrated in which a headed pin 35 extends through the spring 10 and the connector block 20, the head 36 resting on the end coil 11 of the spring. In the example, a washer 32 is also used. On the surface 37 of the connector block 20 remote from the spring receiving surface, conveniently considered as the bottom surface, there is formed an arcuate inclined ramp or cam 38. A pin 39 extends through the bottom end of the pin 35 such that as the pin 35 is rotated, pin 39 engages with the cam 38 pulling the pin 35, and head 36 down, tightening the spring 10, with consequent shearing of the end of the conductor. A stop 40 is provided on the end of the cam 38 to limit rotation of the pin 35 and to prevent pin 39 from moving off the cam. A short flat surface is advisable on the cam adjacent to the stop 40, to avoid having the pin 39 move back down the cam. Alternatively a shallow detent can be formed adjacent to the stop 40 into which the pin 39 will fit.

A threaded clamping or tightening system is more acceptable to a variation in conductor size, whereas a system as in FIGS. 7 and 8 is more restricted. However, a smaller angular rotation is obtained with the cam arrangement, as compared with the threaded arrangement, for tightening. Also the cam type of clamping presets the tightening effort, avoiding overtightending. A positive visual and/or tactile feedback of a male connection can also be obtained with a cam or similar type of arrangement. In a threaded clamping arrangement a rib or stop member can be provided on the edge around the threaded hole 17 (FIG. 1) or around the periphery of the stud 30 (FIG. 6).

The insulation on conductors can vary in hardness, and in resistance to splitting. Local pressure points can be provided on the surface against which the conductor is clamped. These are indicated at 45 in FIGS. 2 and 3. Also illustrated in FIGS. 2 and 3, is a rib or stop member 46 around a threaded hole 17. This rib 46 prevents overtightening, as mentioned above, particularly for small conductors, which can move out radially as they are clamped. The rib 46 is somewhat lower than the overall diameter of the conductor but high enough to prevent damage to the conductor.

Connectors, in accordance with the invention, can be used in many applications, although connection of conductors in telecommunication systems is one particular use. The block is normally molded and can be a single unit or in multiples of connectors.

Where an insert is used, this will normally be of metal, for example tin-plated brass. The spring is typically of phosphor bronze (extra hard or spring temper), or berylium copper—both tin plated, or stainless steel. The hand of the spring can be a left hand spiral, as illustrated, or a right hand spiral.

If desired a second conductor can be inserted under the head of the screw 16, or under nut 31 or under the head 36. As an example, by providing two or more spring formations as in FIGS. 1 and 2 in tandem, it would be possible to shear and clamp more than one conductor.

In addition to the electrical contact obtained by the splitting of the insulation, electrical contact is also obtained between the cut end of the conductor and the spring.

What is claimed is:

1. A self-shearing connector for electrical conductors, comprising:

a body member;

a central member extending from said body member;

a helical compression spring of rectangular cross-section wire surrounding said central member, said spring comprising a lower coil in contact with said body member and an upper coil having an end part with an outer diameter a close sliding fit inside the inner diameter of said lower coil, said coils spaced apart axially for insertion of a conductor therebetween;

means for compressing said spring to grip said said conductor under one of said coils and to push said end part of said upper coil inside said lower coil to shear excess length of the conductor whereby any insulation on said conductor is split to provide direct contact between the conductor and the spring.

2. A connector as claimed in claim 1, said central member comprising a screw, compression of said spring obtained by screwing said screw into said body member.

3. A connector as claimed in claim 1, said central member comprising a threaded member, and a nut on said threaded member, compression of said spring obtained by screwing said nut down on to said spring.

4. A connector as claimed in claim 1, said central member comprising a rod extending through said body member, a head on said rod overlying said spring, and means for pulling said rod through said body member to compress said spring.

5. A connector as claimed in claim 1, said upper coil including an arcuate deformed portion, said deformed portion extending in a direction parallel to the axis of the central member, whereby on compressing said spring said deformed portion is partly flattened.

6. A connector as claimed in claim 1, said upper coil including a part overlying said lower coil, whereby on compression of said spring, the conductor is gripped between said coils, to split said insulation on said conductor.

7. A connector as claimed in claim 6, said lower coil including an end portion extending into said body member, to prevent rotation of said spring on compression thereof.

8. A connector as claimed in claim 7, said end portion of said lower coil extending through said body member to provide a conductor attachment portion.

9. A connector as claimed in claim 1, said lower coil extending for only part of a turn, said end part of said upper coil extending beyond said lower coil, whereby on compression of said spring the conductor is gripped between said upper coil and said body member, to split said insulation on said conductor to provide direct contact between the conductor and said body member.

10. A connector as claimed in claim 9, said lower coil including an end portion extending into said body member to prevent rotation of said spring on compression thereof.

11. A connector as claimed in claim 10, said end portion of said lower coil extending through said body member to provide a conductor attachment portion.

12. A self-shearing connector for electrical conductors, comprising:

a body member;

a plurality of central members spaced apart and extending from said body member;

a helical compression spring of rectangular cross-section wire surrounding each central member, each spring comprising a lower coil in contact with said body member and an upper coil having an end part with an outer diameter a close sliding fit inside the inner diameter of said lower coil, said coils spaced apart axially for insertion of a conductor therebetween; and means for compressing said spring to grip said conductor under one of said coils and to push said end part of said upper coil inside said lower coil to shear any excess length of the conductor whereby any insulation on a conductor is split to provide direct contact between the conductor and the spring.

* * * * *